US008046872B2

(12) United States Patent
Burgess, III et al.

(10) Patent No.: US 8,046,872 B2
(45) Date of Patent: Nov. 1, 2011

(54) CARRIAGE FOR A DOOR

(75) Inventors: Thomas Edward Burgess, III, Clarksville, GA (US); Joerg vom Dorp, Cleveland, GA (US); Michael Leidner, Atlanta, GA (US)

(73) Assignee: Hettich-Heinze GmbH & Co. KG, Spenge (DE)

( * ) Notice: Subject to any disclaimer, the term of this patent is extended or adjusted under 35 U.S.C. 154(b) by 444 days.

(21) Appl. No.: 12/191,841

(22) Filed: Aug. 14, 2008

(65) Prior Publication Data

US 2010/0037427 A1 Feb. 18, 2010

(51) Int. Cl.
*A47H 15/00* (2006.01)

(52) U.S. Cl. ..... 16/97; 16/103; 16/104; 16/105; 49/409; 49/425

(58) Field of Classification Search ..... 16/97–107; 49/409, 425, 411, 410, 125, 126, 127, 128, 49/129; 104/89, 95, 106, 107, 111
See application file for complete search history.

(56) References Cited

U.S. PATENT DOCUMENTS

| | | | | | |
|---|---|---|---|---|---|
| 1,195,197 | A | * | 8/1916 | Frantz | 16/105 |
| 1,761,215 | A | | 6/1930 | Lamm | |
| 1,832,203 | A | * | 11/1931 | Gussack | 16/97 |
| 1,931,796 | A | * | 10/1933 | Hoffman | 16/98 |
| 2,446,887 | A | | 8/1948 | Shearer | |
| 2,783,493 | A | | 3/1957 | Gussack | |
| 2,957,197 | A | | 10/1960 | Johnson, Jr. | |
| 3,155,051 | A | * | 11/1964 | Sherburne | 105/155 |
| 3,193,870 | A | * | 7/1965 | McNinch | 16/97 |
| 3,287,759 | A | | 11/1966 | Foltz | |
| 3,479,682 | A | | 11/1969 | McNinch | |
| 3,813,728 | A | * | 6/1974 | Johnson | 16/97 |
| 3,829,929 | A | * | 8/1974 | Foltz et al. | 16/97 |
| 4,084,289 | A | * | 4/1978 | Naimo | 16/96 R |
| 4,408,369 | A | * | 10/1983 | Labelle | 16/102 |
| 4,642,844 | A | * | 2/1987 | Johnston | 16/98 |
| 6,052,867 | A | * | 4/2000 | Haab et al. | 16/87.6 R |
| 6,209,171 | B1 | | 4/2001 | Pelletier et al. | |
| 6,418,588 | B1 | * | 7/2002 | Haab et al. | 16/91 |
| 6,983,512 | B2 | * | 1/2006 | De Oliveira | 16/97 |

FOREIGN PATENT DOCUMENTS

| | | |
|---|---|---|
| DE | 201 20 587 | 4/2002 |
| EP | 1 403 459 | 3/2004 |
| EP | 1 469 151 | 7/2005 |
| EP | 1 557 516 | 7/2005 |

OTHER PUBLICATIONS

Notification of Transmittal of The International Search Report and the Written Opinion of the International Searching Authority, or The Declaration for PCT/US2009/053584 Dec. 8, 2009. Written Opinion of the International Searching Authority for PCT/US2009/053584, Dec. 8, 2009.

* cited by examiner

*Primary Examiner* — Robert Sandy
*Assistant Examiner* — Emily Morgan
(74) *Attorney, Agent, or Firm* — Barnes & Thornburg LLP

(57) ABSTRACT

A carriage for fitting a suspendable door on a rail is described. The carriage includes a housing and at least one running roller disposed on the housing. The running roller is positioned to engage the rail. An installation plate is included that is adapted to be connected to the suspendable door. A suspension bolt is connected between the housing and the installation plate. A portion of the suspension bolt engages a bearing disposed at one end of either the housing or the installation plate. The bearing permits at least angular displacement if the suspension bolt with respect to either the housing or the installation plate.

10 Claims, 10 Drawing Sheets

Fig. 1
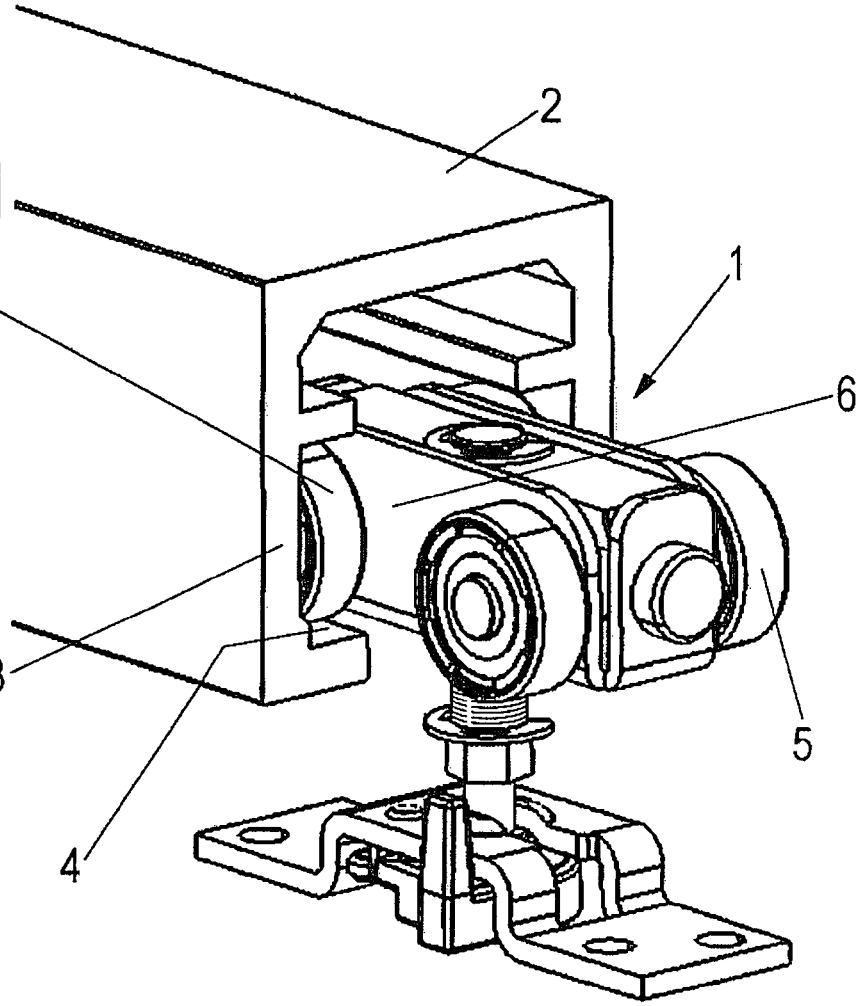
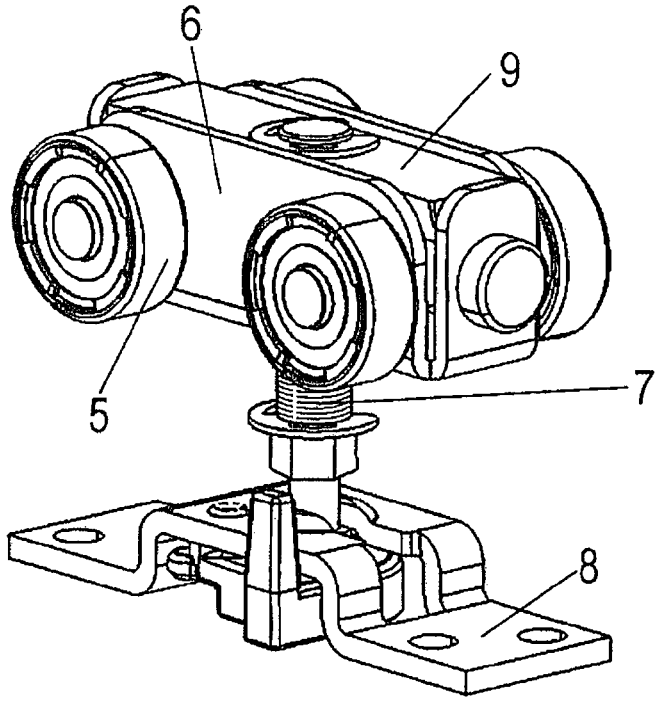
Fig. 2

Fig. 12
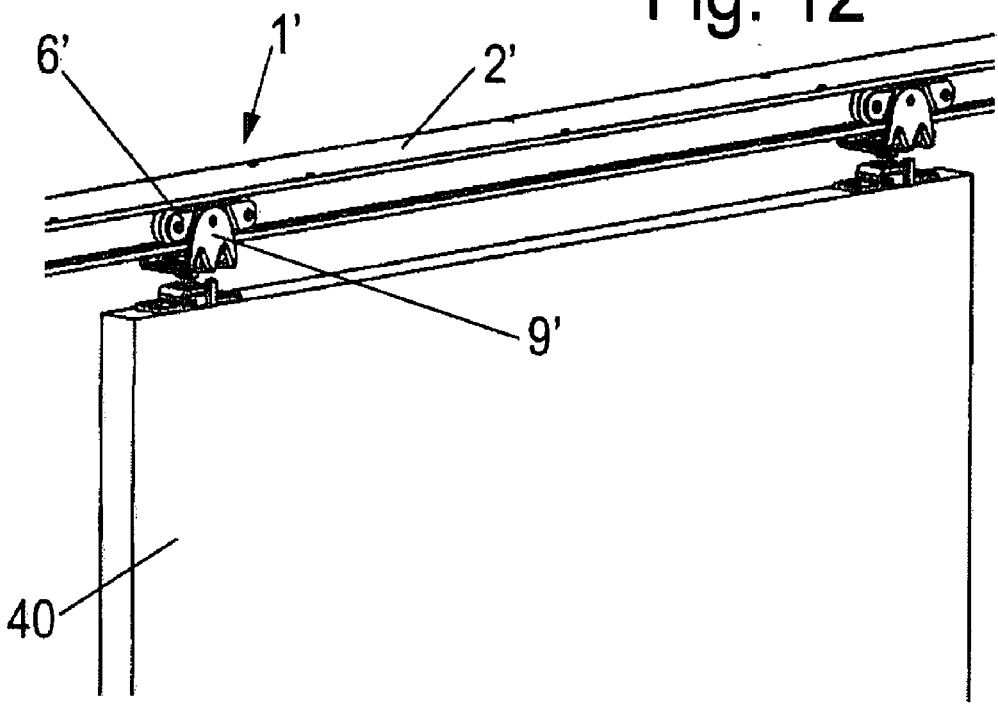
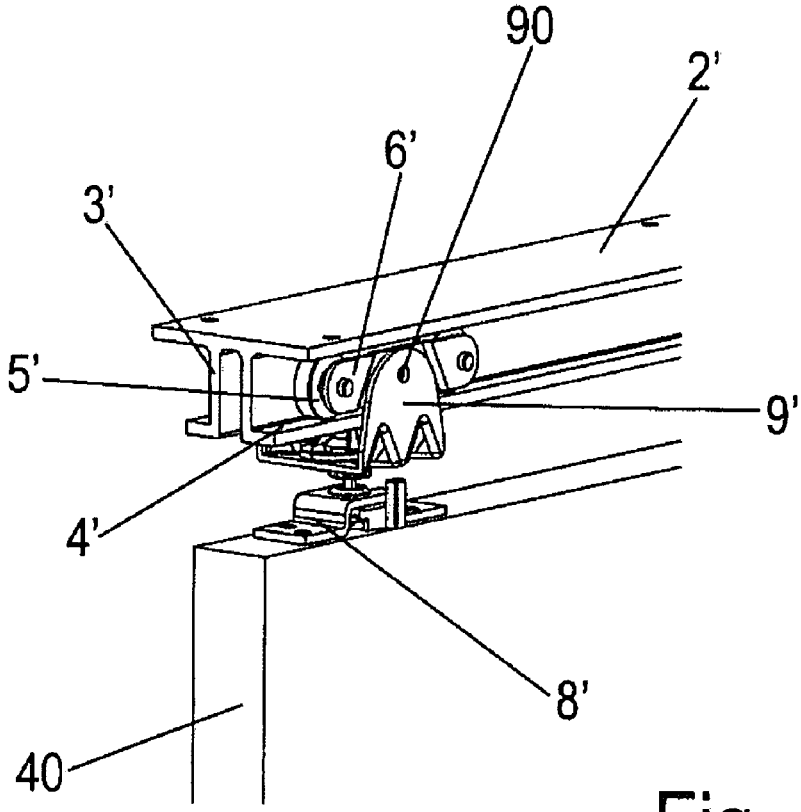
Fig. 13

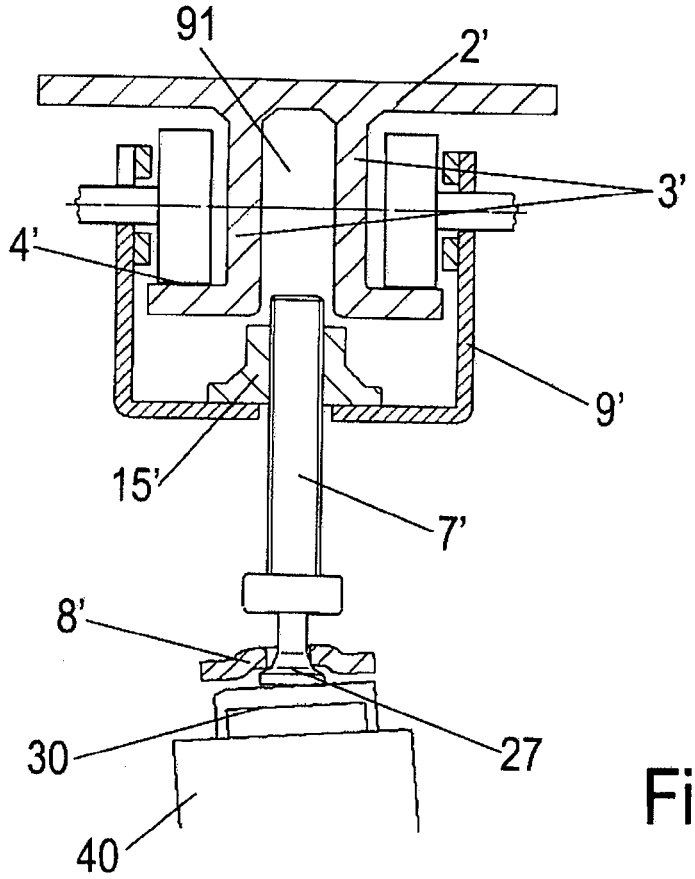
Fig. 14A
Fig. 14B
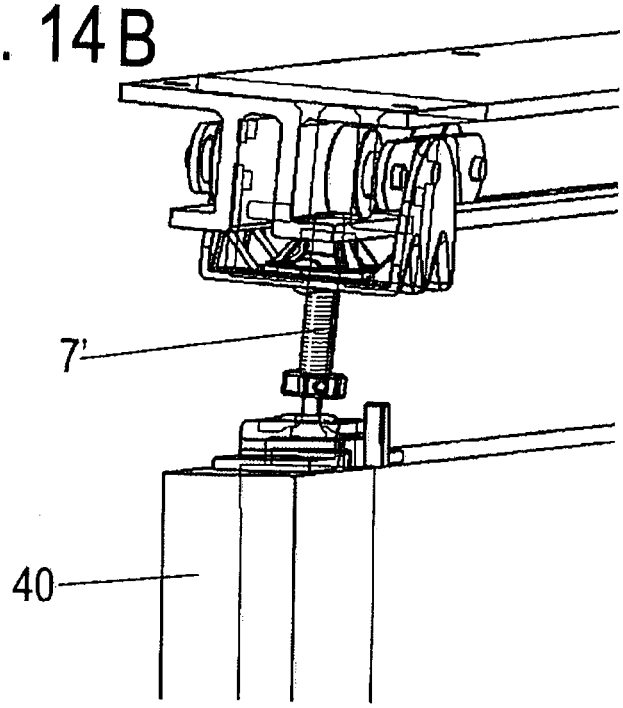

CARRIAGE FOR A DOOR

CROSS-SECTION TO RELATED APPLICATIONS

This is a first-filed U.S. Patent Application and does not rely for priority on any other patent application.

FIELD OF THE INVENTION

The present invention relates to a carriage for fitting a suspension-type door on a rail. More specifically, the invention concerns a carriage for fitting a suspension-type door on a rail. The carriage includes a housing or framework on which at least one running roller is mounted on opposite sides. The carriage also includes a suspension bolt which, at one end, is fixed on an installation plate. The bolt may be connected to a suspension-type door at one end and to a bearing means at the other end.

DESCRIPTION OF RELATED ART

U.S. Pat. No. 6,209,171 discloses an apparatus for fitting a suspension-type door on a rail. A carriage is provided with a housing to which four rollers are mounted in a rotatable manner. The carriage is connected to a bolt, which is fixed on an installation plate that is fitted onto the suspension-type door. The running rollers here are mounted rigidly on the housing, and the entire carriage moves as a single unit on the rail. One problem that may arise with this type of apparatus lies in the rail itself. The rail for securing a suspension-type door may warp or become uneven, thereby introducing deflections and variations. If the rail becomes warped, deflected, or uneven, the carriage is guided in a skewed manner on the rail, which gives rise to considerable material loading. Moreover, as should be apparent, once the carriage becomes skewed, it is no longer possible for the carriage to slide smoothly on the rail.

U.S. Pat. No. 3,287,759 discloses a carriage, which is intended for fitting a suspension-type door on a rail. In the disclosed apparatus, a bolt is mounted in a vertically resilient manner on the carriage. The bolt makes it possible to damp certain impact forces when the carriage passes over warped, deflected, or uneven portions of the rail. Of course, it remains possible that the carriage may jam if the rail is skewed or if warped, deflected, or uneven portions of the rail exceed predetermined tolerances.

SUMMARY OF THE INVENTION

It is, therefore, one aspect of the invention to provide an apparatus that includes a carriage designed to reliably operate despite the presence of warped, deflected, or uneven portions of the rail on which the carriage rolls.

The apparatus of the invention is intended to support a suspension-type door and compensate for unevenesses, warping and height tolerances of the running rail.

In addition, the invention is intended to provide a reliable and straightforward fitting between at least the carriage and the rail.

With respect to one embodiment contemplated for the invention, a suspension bolt is retained on the carriage by a bearing (or similar means) such that it pivots relative to the running rollers. In this embodiment, therefore, it is possible to compensate for unevenesses or twisting of the rail since the suspension bolt may be moved relative to the running rollers. In this example, the suspension bolt may compensate for twisting of the rail if, on the one side, the running surface on the rail is arranged in elevated fashion. As should be apparent, if the bolt is fixedly mounted to the carriage and if one side of the rail is skewed relative to the other side, the bolt would become tilted from a vertical displacement as the carriage moves along the rail. A flexible mounting makes it possible to compensate for such warping of the rail.

In one contemplated configuration for the invention, the bearing containing the suspension bolt is supported on at least one axial element with running rollers being mounted at the opposite ends of the axial element.

It is contemplated that at least one axial element will be disposed through the housing. Vertical slots in the housing permit through-passage of the axial element. The vertical slots permit the axial element to pivot relative to the housing, and thus relative to the other axial element which may be present. In other words, the running rollers at one end of the axial element may be vertically displaced with respect to the running roller at the other end of the axial element.

It is contemplated for one embodiment of the invention that the carriage includes two axial elements and four running rollers. In this embodiment, the axial elements are coupled to one another via the housing or via a suitable alternative framework.

In one contemplated embodiment of the invention, the suspension bolt is secured in a bearing bar in a fashion permitting the position of the suspension bolt to be adjusted with respect to the bearing bar. For example, it is contemplated that the suspension bolt may be threaded so that its height may be adjusted with respect to the bearing bar. The bearing bar, in turn, may be supported on the two axial elements of the carriage.

In an embodiment incorporating a bearing bar, it is contemplated that the bearing bar may be rounded on its lower surface so that the bearing bar may permit tilting with respect to the axial elements. Moreover, with a rounded lower surface, the bearing bar presents a single bearing point on the axial elements. This permits the bearing bar to pivot laterally on the axial elements.

Where the bearing bar incorporates a rounded lower surface, it is contemplated that the bearing bar may be a half cylinder, which is a cylinder divided longitudinally in half at its center. It is contemplated that a half cylinder design makes it possible for the bearing means to pivot smoothly relative to the axial elements.

With respect to the suspension bolt, it is contemplated that the suspension bolt has a plurality of portions. In one contemplated embodiment, the top portion is expected to include a thread to engage a corresponding threaded bore in the bearing bar. The thread and threaded bore permit a height adjustment between the suspension blot and the bearing bar.

Where the apparatus of the invention includes a threaded suspension bolt engaging a threaded bore in a suspension bar, the height of the suspension-type door may be adjusted relative to the carriage by rotating the suspension bolt about its longitudinal axis. In this embodiment, a hexagonal bolt or stub may be provided at or near the bottom of the suspension bolt to permit rotation (or actuation) of the suspension bolt.

In another contemplated embodiment of the invention, retaining rings may be introduced into appropriate grooves at the ends of the threaded portion of the suspension bolts. The retention rings are expected to serve as end stops that define the extent of the adjusting region of the suspension bolt.

At the bottom end of the suspension bolt, it is contemplated that a tapered portion may be provided. The tapered portion may include a head, which may be introduced into a corresponding slot in the installation plate fastened on the suspension-type door.

In one embodiment of the invention, it is contemplated that the housing is made from a bent metal sheet.

The housing is expected to be guided within the rail.

It is contemplated that the housing may include elastic dampers on its ends (or end sides). The dampers are expected to damp the action of the carriage when striking against a stopping element.

According to a further configuration of the invention, the carriage includes two running rollers disposed on each side of the rail. In this contemplated configuration, the running rollers are connected to one another via a framework on each side of the rail. As a result, in this embodiment, the carriage includes two frameworks, one for each pair of rollers. A bearing profile (or element) connects the two bearing profiles to one another. The bearing profile may include a U-shaped member that is pivotably disposed on the two frameworks, extending from one framework to the other. The bearing profile may be mounted in a rotatable manner on each respective framework by way of two legs, the axes of rotation of the bearing profile being arranged parallel to the axes of rotation of the running rollers. With this construction, it is possible to compensate for height by virtue of the pivoting motion of the bearing profile relative to the two frameworks, by virtue of the running rollers, and also by virtue of the frameworks being pivoted relative to one another. In particular, it is contemplated that height adjustment is made possible because the running rollers may be arranged at different heights. The pivotable mounting of the bearing profile on the two frameworks permits the bearing profile to compensate for height variations in a first direction. Moreover, mounting of the suspension bolt on an installation plate in relation to the suspension-type door accommodates adjustment in a second direction, perpendicular to the first direction. It is contemplated that this configuration permits flexible adaptation to different heights between the running surfaces of the running rollers.

In one contemplated embodiment of the apparatus of the invention, it is possible to effectively adjust the height of the door via a suspension bolt. In particular, the suspension bolt may be provided with an external thread above the base of the bearing profile. The external thread may be screwed into a nut secured on the bearing profile. The rail may have two L-shaped webs with a horizontal running surface for the running rollers. A gap may be provided between the webs. A top portion of the suspension bolt may be introduced into this gap, in which case a compact construction is ensured along with height adjustment.

Other aspects of the invention also may be appreciated from the drawings appended hereto and the description that follows.

BRIEF DESCRIPTION OF THE DRAWINGS

The invention will be explained in more detail hereinbelow using an exemplary embodiment and with reference to the accompanying drawings, in which:

FIG. 1 shows a perspective view of a carriage according to the invention on a rail;

FIG. 2 shows a perspective view of the carriage without a rail;

FIG. 12 shows a perspective view of a second exemplary embodiment of a carriage for the suspension of a suspension-type door;

FIG. 13 shows a perspective view of the carriage from FIG. 12;

FIGS. 14A and 14B show two views of the carriage from FIG. 13 in different angled positions;

DETAILED DESCRIPTION OF EMBODIMENT(S) OF THE INVENTION

Figure 3:
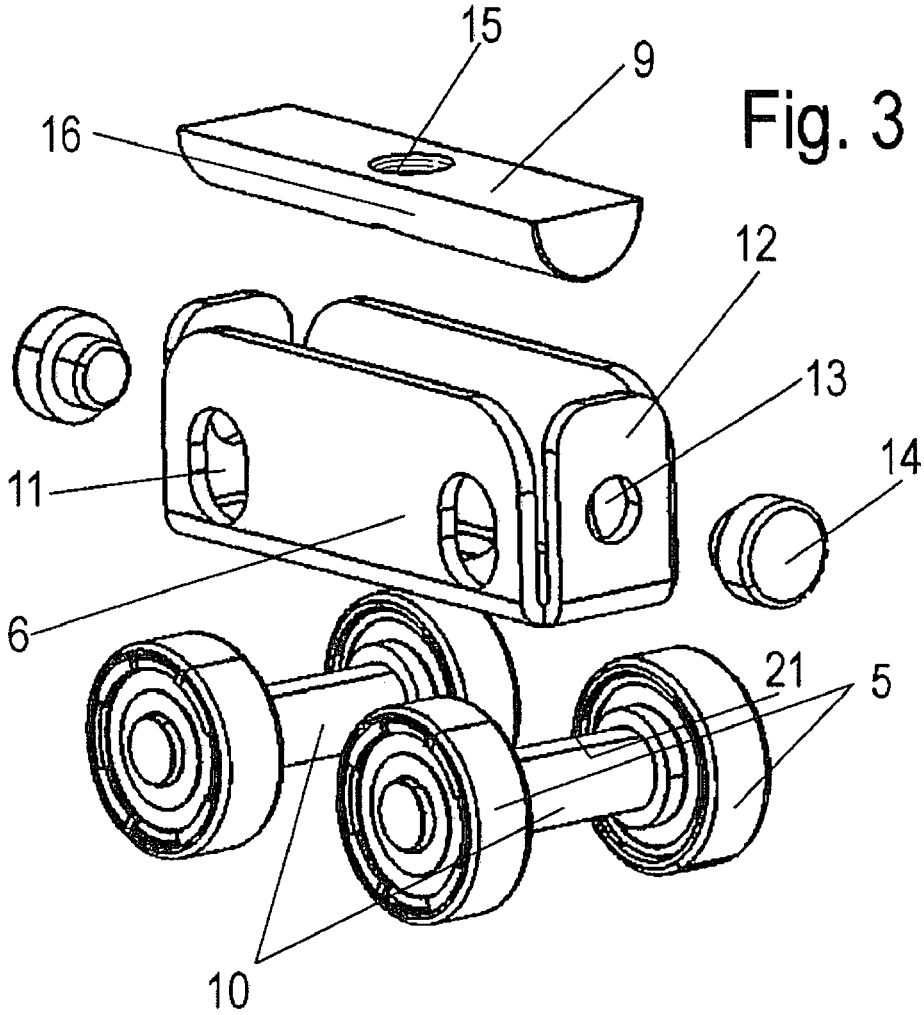
FIG. 3 shows an exploded illustration of the essential parts of the carriage from FIG. 2.

The discussion that follows encompasses one or more embodiments that are considered exemplary of the scope of the invention. The embodiments are provided to illustrate the broad scope of the invention and are not intended to be limiting of the invention.

A carriage 1 is guided on a rail 2 which is of essentially U-shaped design and cross section and has two legs 3. The ends of the legs 3 include inwardly directed webs with running surfaces 4. Running rollers 5, which are arranged adjacent to a housing 6 of the carriage 1, are supported on the running surfaces 4.

A suspension bolt 7 projects downward from the carriage 1 and is secured on an installation plate 8, which is secured on a suspension-type door. The suspension-type door may be part of a piece of furniture, for example. Of course, the invention is not limited to furniture construction, as should be appreciated by those skilled in the art.

As can be seen in FIG. 3, the carriage 1 comprises a bearing bar 9. The bearing bar 9 takes the form of a longitudinally divided half-cylinder in this embodiment. The bearing bar 9 has a central threaded opening 15 for accommodating a threaded portion of the suspension bolt 7. The downwardly directed side 16 of the bearing bar 9 is rounded or curved and is supported on two axial elements 10, which carry a respective running roller 5 at opposite ends.

In the embodiment illustrated in FIG. 3, for example, it is contemplated that the housing 6 is produced from a bent metal sheet. Opposite side walls of the housing 6 are provided with vertical slots 11 through which the axial elements 10 pass. The axial elements 10 are permitted to move up and down, within limits, in the slots 11.

As illustrated, the axial elements 10 are positioned in a direction perpendicular to the longitudinal direction of the housing 6. The axial elements 10 rotate relative to one another and to the housing 6. In the longitudinal direction of the housing 6, the axial elements 10 are mounted in a more or less play-free manner in the slots 11.

As also shown in FIG. 3, the front end side 12 of the housing 6 includes an opening 13 into which an elastic damper 14 may be positioned. The elastic damper 14 in this embodiment is contemplated to be made of rubber. The elastic damper 14 fits into the opening 13. A damper 14 also may be secured on a rear end wall in the same manner. It is also possible for the damper or the dampers to be configured in the form of pneumatically or hydraulically operating piston/cylinder units. Other types of dampers also may be employed without departing from the scope of the invention.

Figure 4:
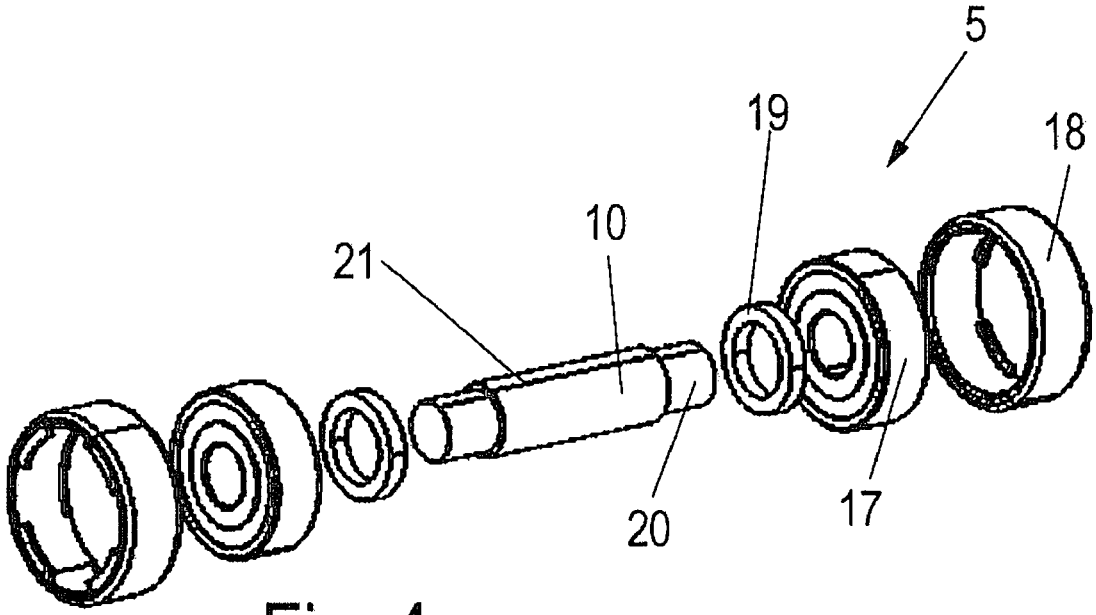
FIG. 4 shows an exploded illustration of the axial elements of the carriage from FIG. 3.

FIG. 4 illustrates, in detail form, one axial element 10 onto which the running rollers 5 are mounted. The axial elements 10 includes planar bearing surfaces 21, which are intended to contact the rounded side 16 of the bearing bar 9. Reduced-diameter end portions 20 are arranged at opposite ends of the axial element 10 and have the running rollers 5 fixed on them. A metal ring 19 is positioned on the axial element 10. The metal ring 19 axially secures the running roller 5. The ring 19 also acts as a spacer in relation to the housing 6.

The running roller 5 may incorporate a rotary bearing 17, for example a ball bearing. Moreover, the running roller 5 may incorporate a sleeve made of plastic 18. In the illustrated embodiment, the running roller 5 is expected to rotate smoothly in relation to the axial element 10. In the illustrated embodiment, the axial element 10 does not rotate about its longitudinal axis in relation to the housing 6. Of course, it is contemplated that the axial element 10 may be permitted to rotate, as desired or as needed.

Figure 5:
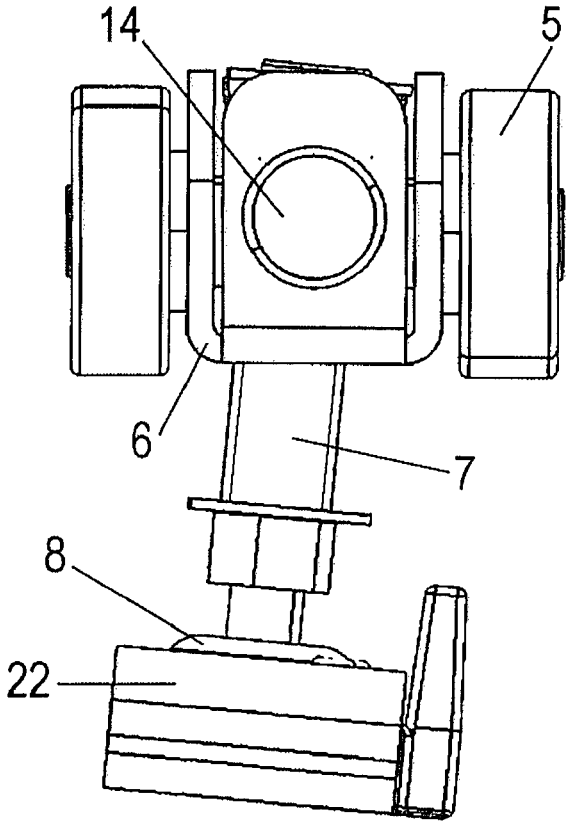
FIG. 5 shows a front view of the carriage from FIG. 2 with the suspension bolt pivoted.

As is illustrated in FIG. 5, the suspension bolt 7 is pivoted between to the running rollers 5. This is desirable so that a suspension-type door 22 may be pivoted about a horizontal axis running in the movement direction of the running rollers 5. In the alternative, this is desirable for a suspension-type door 22, which is guided along, and thereby supported by, a floor rail, in order to compensate for tolerances and unevenness in the floor rail.

Figure 6A:
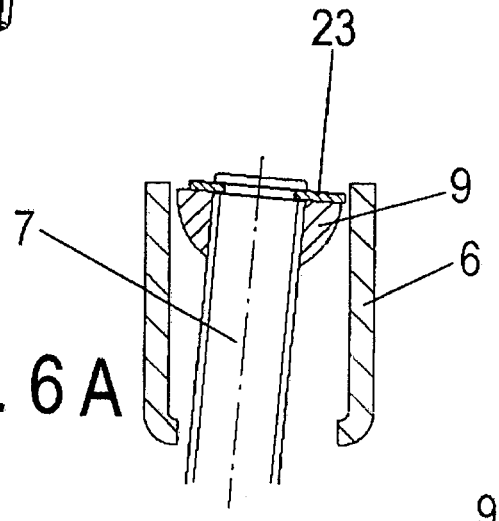
FIG. 6A shows a sectional view, in detail form, of the carriage from FIG. 5.

FIG. 6A shows the bearing for the suspension bolt 7. The maximum adjustment path of the suspension bolt 7 (as measured in a downward direction with respect to the bearing bar 9) is limited at the top end by a retaining ring 23. The suspension bolt 7 is illustrated as being pivoted out of its center position in relation to the housing 6.

Figure 6B:
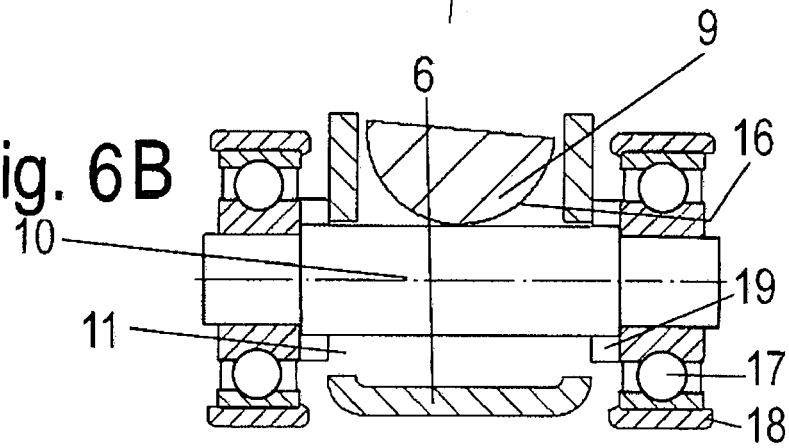
FIG. 6B shows a sectional view, in detail form, of the carriage from FIG. 5.

FIG. 6B shows the bearing bar 9 in the region of the running rollers 5. The bearing bar 9 has its rounded side 16 resting on one of the axial elements 10. As a result, a single bearing point (or one bearing line) is formed between the bearing bar 9 and the axial element 10 (or plural axial elements in the case of a bearing line). In this contemplated configuration, the bearing bar 9 may "roll" on the axial element 10 in the pivoting direction.

It is also the case that the axial elements 10 are mounted in a movable manner relative to the housing 6. Specifically, as noted above, the axial elements 10 engage through the vertical slots 11 in the housing 6. As such, the axial elements 10 may be rotated (or tilted), within limits, about a horizontal axis extending in the running direction. Therefore, the axial elements 10 may be pivoted in relation to one another and in relation to the housing 6. This tilting or pivoting action of the axial elements 10 makes it possible to compensate for unevenesses and warping of the running rail. Since the axial elements 10 are guided in the slots 11 with a small amount of play, as observed from the running direction, rotation (or tilting) about a vertical axis is prevented, at least in this contemplated embodiment.

Figure 7:
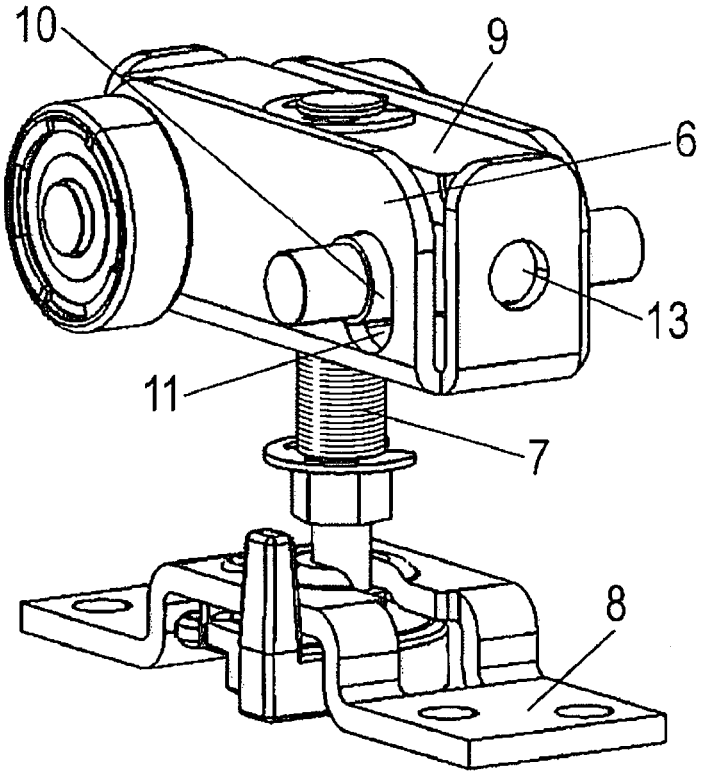
FIG. 7 shows a perspective view of the carriage from FIG. 2 without running rollers.

FIG. 7 shows the carriage without any running rollers 5 on the front axial element 10, In FIG. 7, it can be seen that the axial element 10 are moveable in the vertical direction within the slots 11 in the housing 6. If one of the four running rollers 5 passes over any unevenness, the vertically movable mounting of the running rollers 5, via the axial elements 10 and the bearing bar 9, allows the suspension bolt 7 to be displaced relatively uniformly since this mounting makes it possible to compensate for unevenesses.

Figure 8:
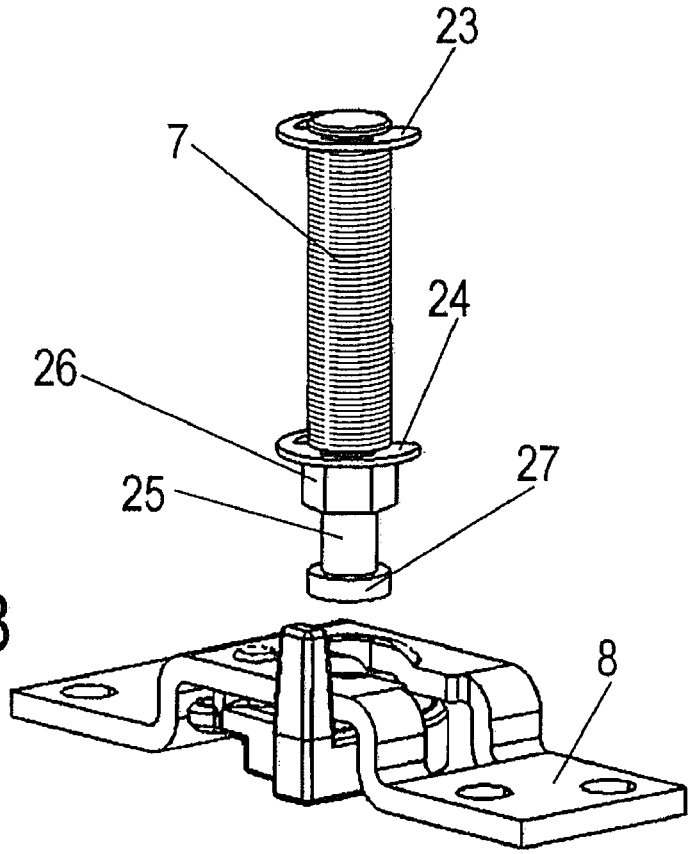
FIG. 8 shows a perspective view of the suspension bolt with an installation plate.

FIG. 8 illustrates the suspension bolt 7 in detail form. At the top end, a retaining ring 23 has been introduced into a groove. The retaining ring 23 limits the maximum possible displacement path of the suspension bolt 7 in the downward direction, since the retaining ring 23 may rest as a stop on the planar surface of the bearing bar 9. In the same way, a bottom retaining ring 24 is secured in a groove of the suspension bolt 7 at the bottom end. The bottom retaining ring 24 acts as a stop in the event of maximum adjustment in the upward direction. Between the top retaining ring 23 and bottom retaining ring 24, the suspension bolt 7 is provided with a thread, by means of which it is guided in the threaded bore 15 in the bearing bar 9. A drive portion, in the form of a hexagonal bolt or stub 26, is provided on the suspension bolt 7 beneath the bottom retaining ring 24. A tool may be used to engage the drive portion to adjust of the height of the suspension-type door in relation to the carriage 1.

A tapered portion 25 and an installation head 27 are formed at the end of the suspension bolt 7. In the illustrated embodiment, the installation head 27 has a larger diameter than the tapered portion 25. The installation head 27 serves as a connection to the installation plate 8, which is fitted on the suspension-type door.

Figure 9:
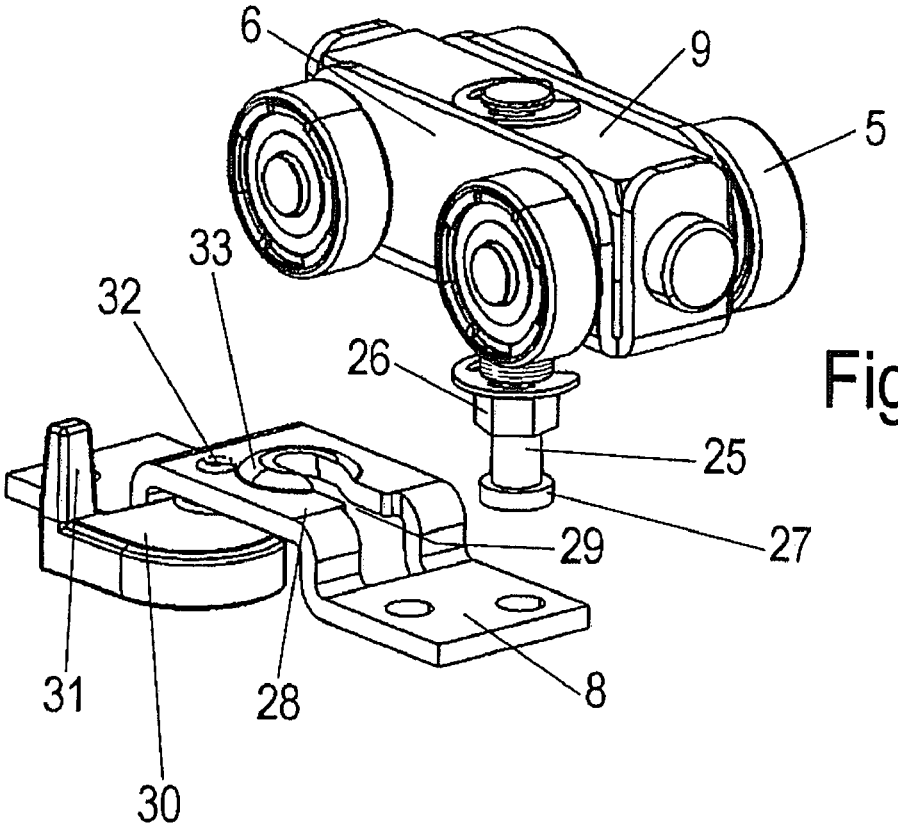
FIG. 9 shows a perspective view of the carriage prior to fitting.
Figure 10:
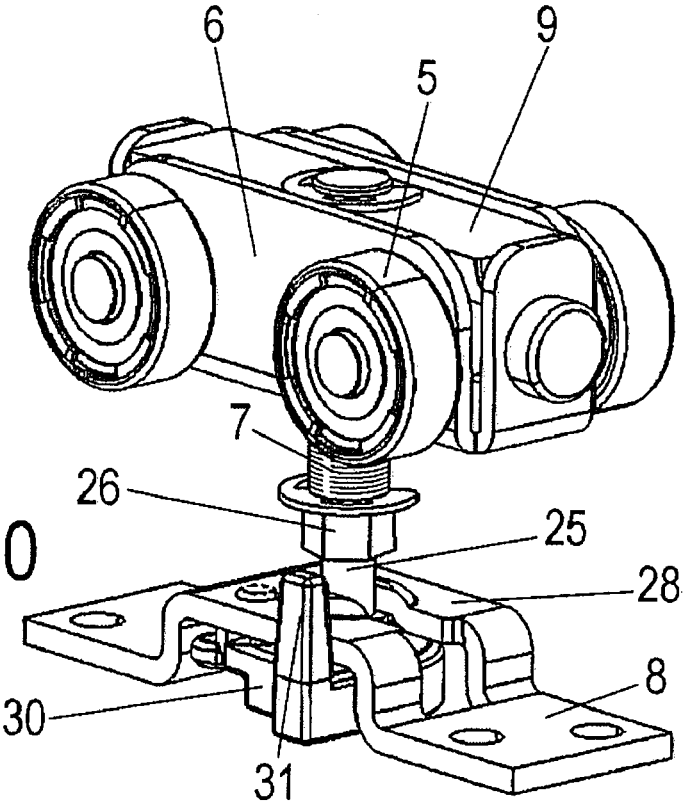
FIG. 10 shows a perspective view of the carriage from FIG. 9 following fitting.

FIG. 9 illustrates the carriage prior to fitting on the installation plate 8. FIG. 10 illustrates the carriage 1 once it has been fitted and secured.

The installation plate 8 has an upwardly projecting portion 28. A slot 29 (also referred to as an introduction slot) extends in the movement direction of the carriage 1. The slot 29 accommodates the tapered portion 25 of the suspension bolt 7. For fitting purposes, the tapered portion 25 of the suspension bolt 7 is introduced into the introduction slot 29. As is apparent, the enlarged-diameter head 27 engages behind the projecting portion 28. The slot 29 terminates in a circular mount 33, which is widened upwardly to a predetermined extent in the vertical direction and in which the installation head 27 of the suspension bolt 7 latches as a result of the weight of the suspension-type door fitted on the installation plate 8. In this way, during fitting, the suspension-type door is temporarily secured on the carriage 1, in the movement direction of the carriage 1, and in the direction of the opening of the introduction slot 29.

In order to secure the suspension bolt 7 on a permanent basis, a plate-like closure element 30 is provided on the projecting portion 28. The closure element 30 is mounted on the projecting portion 28 such that it may be rotated around an axial element 32. A projecting grip portion 31 is formed on the closure element 30 to facilitate rotation of the closure element 30.

After the tapered portion 25 has been introduced into the mount 33, the closure element 30 is pivoted until it reaches the position shown in FIG. 10. In this position, the closure element 30 latches to the installation plate 8. Latching of the closure element 30 to the installation plate 8 discourages inadvertent dislocation of the tapered portion 25 from the installation plate 8.

The suspension bolt 7 is retained in captive fashion on the installation plate 8 via the tapered portion 25 and the head 27.

The closure element 30 prevents vertical movement of the suspension bolt 7 relative to the installation plate 8. The closure element 30 also locks the suspension bolt within the installation plate 8 with respect to the slot 29. As a result of the closure element 30, the head 27 is locked in the mount 33. Since the mount 33 projects upwardly and abuts against the head 27, the tapered portion 25 may not be pulled out of the introduction slot 29 when the closure element 30 is closed.

In the illustrated embodiment, the mount 33 has a dome-shaped configuration that allows the head 27 of the suspension bolt 7 to be pivoted to a limited extent therein. In addition, the domed shape also facilitates angular adjustment between the suspension-type door and the carriage 1. Furthermore, the suspension bolt 7 may be rotated about its longitudinal axis in the mount 33, this being necessary for height adjustment, as discussed above.

Figure 11A:
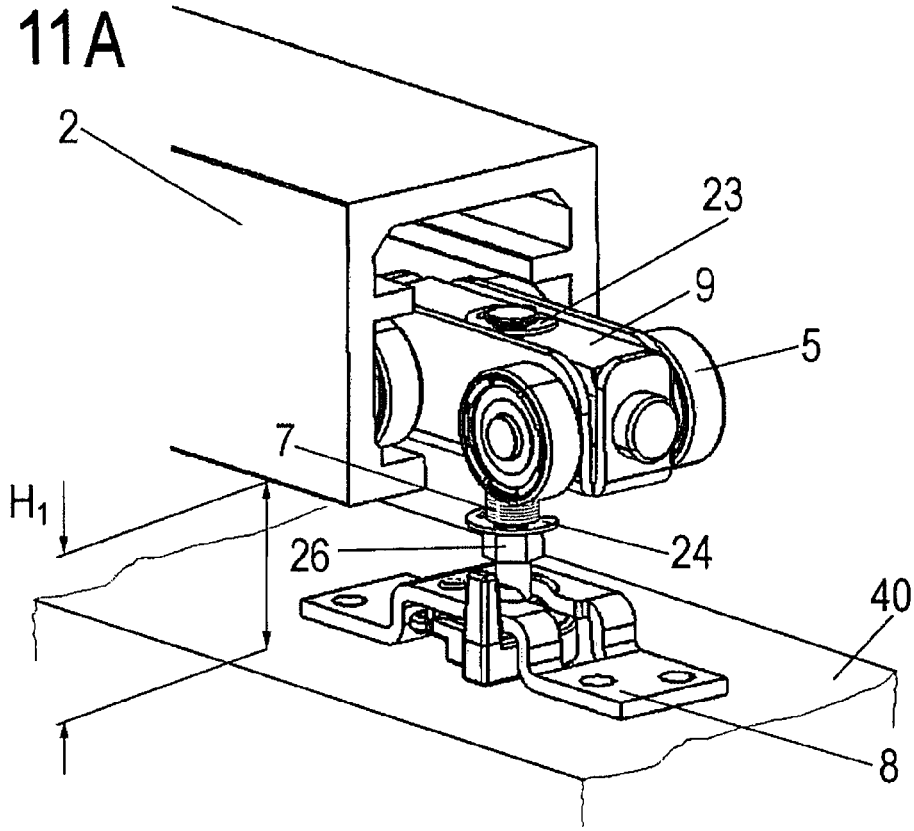
FIG. 11A shows a view of the carriage with the suspension bolt adjusted downward.
Figure 11B:
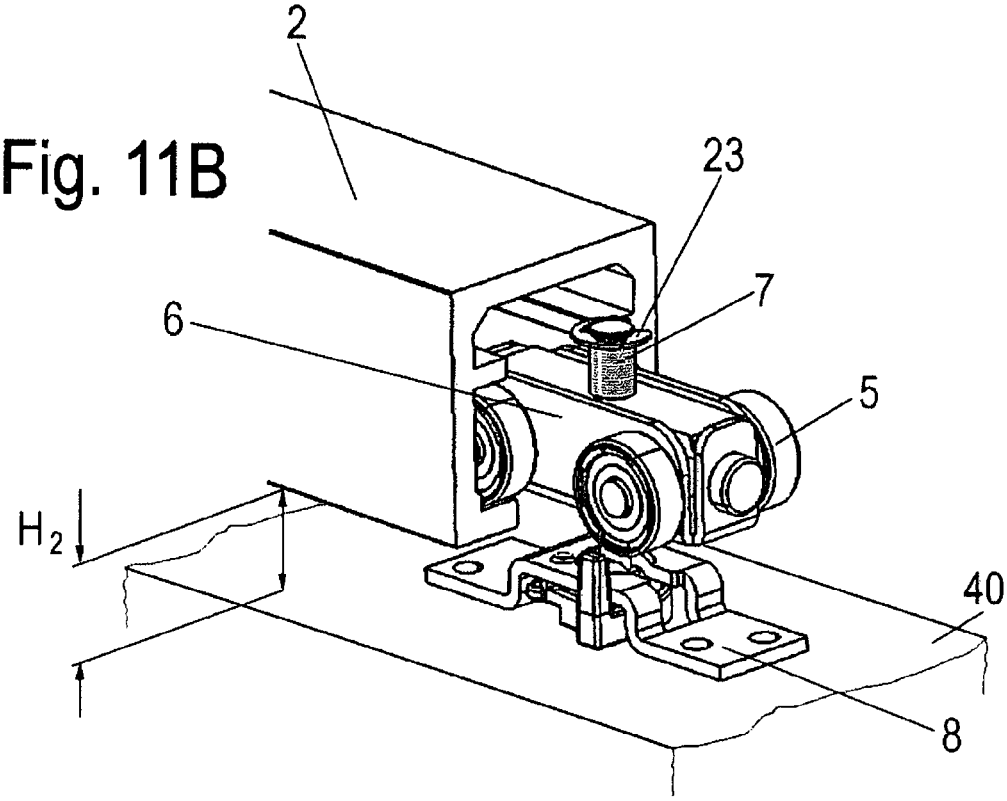
FIG. 11B shows a view of the carriage with a suspension bolt adjusted upward.

FIGS. 11A and 11B illustrate the possible maximum height-adjustment positions. In FIG. 11A, the installation plate 8 is fitted on a suspension-type door 40, and the retaining ring 23 butts against the bearing bar 9. This results in a spacing distance $H_1$ between the suspension-type door 40 and the rail 2.

In FIG. 11B, the suspension bolt 7 has been rotated (via the drive portion 26), thereby causing the thread on the suspension bolt 7 to be screwed into the bearing bar 9. Therefore, the suspension bolt 7 projects, in the upward direction, from the bearing bar 9. As is illustrated in FIG. 11B, the spacing between the suspension-type door 40 and the rail 2 is decreased to a spacing distance $H_2$.

In the embodiment illustrated, the housing 6 is a metal sheet bent into a box form or shape. It is, of course, also possible to modify the shape or form of the housing 6. In other words, the housing 6 may take any suitable shape for a particular environment. As should be apparent, the housing 6 establishes a framework on which the running rollers 5 are guided.

In the embodiment of the housing 6 illustrated in FIGS. 11A and 11B, the housing surrounds the carriage 1 together with the sunning rollers 5 and the axial elements 10. It is contemplated, however, that the housing may be dispensed with altogether, thereby resulting in a design where the rollers 5 are visible on a suitable running rail. In other words, it is contemplated that the axial elements 10 may be fixed to the bearing bar 9, in the direction of travel of the carriage, and that the bearing bar 9 may be profiled with depressions, in which case it is possible to dispense with the housing 6. In this contemplated embodiment, the bearing bar 9 performs the function of the housing 6.

FIGS. 12 to 16C illustrate this second exemplary embodiment. Here, a carriage 1' is illustrated. The carriage 1' is guided on a rail 2'. As should be apparent, two carriages 1' are guided, spaced apart from one another on the rail 2', such that a suspension-type door 40 may be fitted onto the two carriages 1'.

As can be seen from FIG. 13, the rail 2' has two L-shaped webs 3', each of which are angled outwardly to establish running surfaces 4'. In each case, two (or more) running rollers 5' are guided on the two running surfaces 4'. The running rollers 5' are connected to one another via a framework 6'. The axial elements of the running rollers 5' are retained on the framework 6', as illustrated.

A bearing profile 9' is mounted in a rotatable manner on the two frameworks 6', the bearing profile 9' having a U-shaped contour. As illustrated, the bearing profile 9' includes the two legs, each of which are pivotably connected to respective ones of the frameworks 6' via axial elements 90. As shown, the axial elements 90 are arranged parallel to the axial elements of the running rollers 5'.

As is shown in FIGS. 14A and 14B, a suspension bolt 7' engages through the bearing profile 9' in a base region. A nut 15' is secured in a rotationally fixed manner on the bearing profile 9', above the base of the bearing profile 9'. The suspension bolt 7' can be screwed into the nut 15' by way of its external thread, this making it possible for the door, which is fastened on the suspension bolt 7, to be adjusted in height relative to the bearing profile. Between the two L-shaped legs 3', the rail 2' forms a gap 91. The gap 91 is sufficiently wide that a top end portion of the suspension bolt 7' projects therein. As a result, when the suspension bolt 7' is manipulated to adjust the height of the suspension door, the suspension bolt 7' does not interfere with the opening or closing of the door. The suspension bolt 7' has, on the underside, a thickened installation head 27, which is retained on an installation plate 8'. A closure element 30 is arranged to the underside of the installation head 27. The closure element 30 restricts vertical movement of the installation head 27. The closure element also prevents inadvertent dislocation of the installation head 27, as discussed above.

The installation head 27 is arranged on the installation plate 8' so as to provide a certain amount of lateral pivotability, as is illustrated in FIGS. 14A and 14B. In addition, the bearing profile 9' is mounted on the framework 6' such that it may be rotated about the axial element 90. As a result, this embodiment of the invention provides flexible mounting of the suspension-type door 40 in a number of directions, axial and otherwise.

Figure 15A:
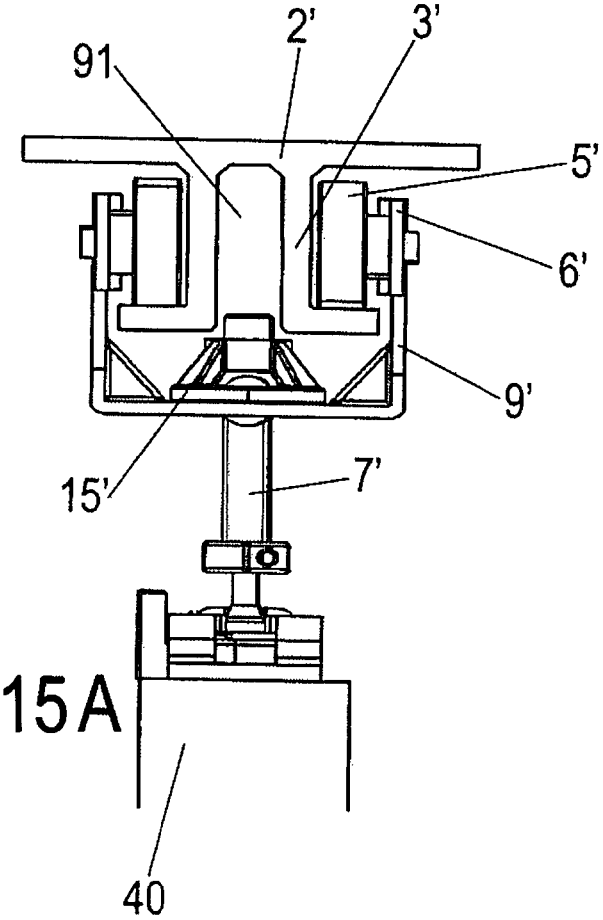
FIGS. 15A and 15B show two views of the carriage from FIG. 13 with the suspension-type door in different height positions.
Figure 15B:
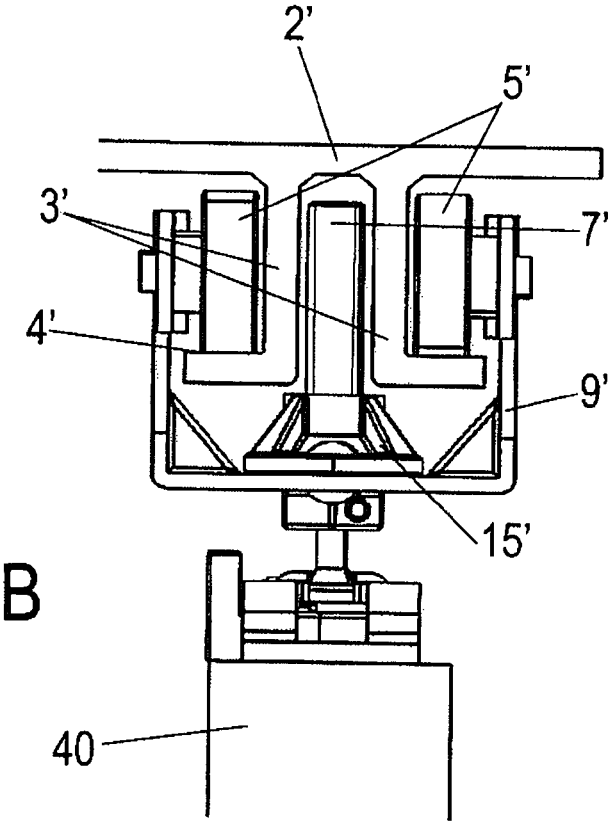

FIGS. 15A and 15B illustrate the suspension bolt 7' in different positions, the suspension-type door 40 in FIG. 15A being retained on the rail 2' in the state in which it is suspended at a low level, whereas, in FIG. 15B, the suspension bolt 7' has been screwed into the gap 91 between the legs 3' by way of a top portion, in which case the suspension-type door 40 is arranged in relatively close proximity to the rail 2'. The stepless height adjustment takes place by rotation of the suspension bolt 7'. To accomplish this, the suspension bolt 7' includes, at its bottom portion, an appropriate handle. As in the prior embodiment, the suspension bolt 7' may be provided with a hexagonal surface (or other surface) that is engageable by a tool to facilitate rotation of the suspension bolt 7'.

Figure 16A:
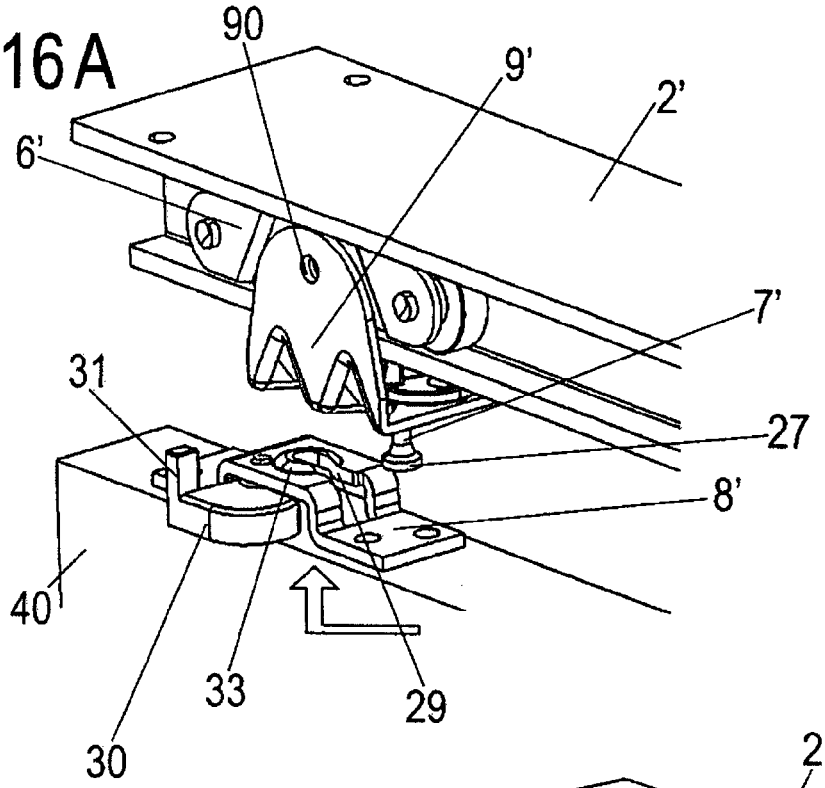
FIGS. 16A to 16C show a number of perspective views of the carriage from FIG. 13 during fitting.

FIG. 16A illustrates the fitting the suspension bolt 7' on the installation plate 8. The suspension bolt 7' is introduced, through an introduction slot 29, in the installation plate 8'. As illustrated, the thickened installation head 27 engages beneath a projecting portion 33 of the installation plate 8'.

Figure 16B:
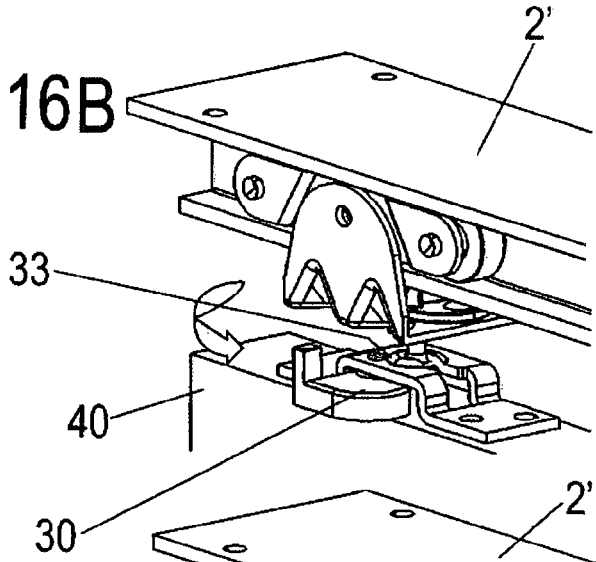
Figure 16C:
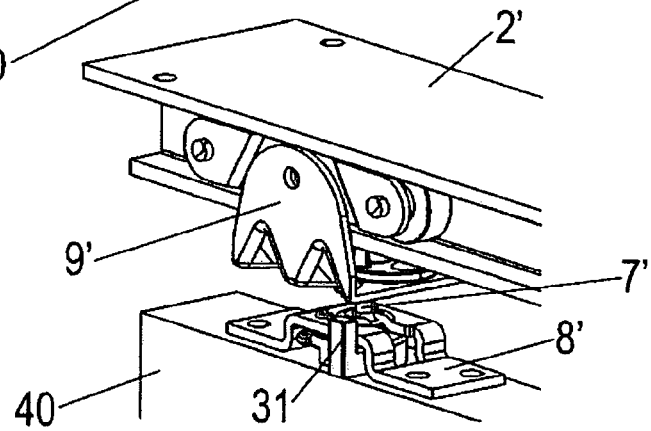

As is shown in FIG. 16B, following introduction of the installation head 27 into an upwardly projecting mount 33, a closure element 30 is pivoted about a vertical axis. The closure element 30 prevents movement of the suspension bolt 7' in the vertical direction relative to the installation plate 8'. It also prevents egress through the slot 29. As a result, the closure element 30 secures the suspension bolt 7' in the mount 33. This results in the position which is shown in FIG. 16C, in which the suspension bolt 7' is locked on the installation plate 8' and the introduction slot is closed by the closure element.

As noted above, the embodiments of the invention discussed above are presented merely to illustrate the breadth and scope of the invention. The embodiments are not intended to be limiting of the invention. To the contrary, the invention is intended to encompass variations and equivalents to the embodiments discussed above, as should be appreciated by those skilled in the art.

What is claimed is:

1. A carriage suspending a door on a rail, comprising:

a housing;

four running rollers disposed on the housing, the four running rollers being positioned to engage the rail;

two axial elements on which the running rollers are disposed;

an installation plate, adapted to be connected to the suspendable door;

a suspension bolt connected between the housing and an installation plate, a portion of the suspension bolt being secured on a bearing bar;

the bearing bar being disposed within the housing and disposed moveably with respect to the housing to permit at least angular displacement of the suspension bolt with respect to the housing; and wherein the bearing bar includes a rounded convex lower surface and is supported by the two axial elements.

2. The carriage of claim 1, wherein the axial elements are disposed through the housing so that the running rollers are disposed exterior to the housing.

3. The carriage of claim 2, wherein the housing includes two slot-shaped openings through which the axial elements pass, the slot-shaped openings being arranged to permit movement of the axial elements therein.

4. The carriage of claim 3, wherein the slots include a vertical dimension that is greater than a diameter of each of the axial elements and also a horizontal dimension that is greater than the diameter of each of the axial elements but less than the vertical dimension.

5. The carriage of claim 1, wherein the bearing bar is a half-cylinder divided through its centerpoint.

6. The carriage of claim 1, wherein the housing includes a bent, metal sheet.

7. The carriage of claim 1, further comprising:

at least one damper affixed to at least one end of the housing.

8. The carriage of claim 1, further comprising:

a closure element disposed on the installation plate to secure the suspension bolt to the installation plate.

9. The carriage of claim 8, wherein the installation plate includes a slot that receives the suspension bolt therein, wherein the closure element is pivotally attached to the installation plate such that rotation of the closure element closes the slot and prevents egress of the suspension bolt from the slot, and wherein the closure element also discourages vertical displacement of the suspension bolt within the slot.

10. The carriage of claim 9, wherein the rail includes two L-shaped webs having at least one horizontal running surface for the running rollers.

* * * * *